US005736667A

United States Patent [19]

Muñostes et al.

[11] Patent Number: 5,736,667

[45] Date of Patent: Apr. 7, 1998

[54] AUTOMATIC FIREARM ARRANGED FOR HIGH SAFETY AND RAPID DISMANTLING

[76] Inventors: Luis Eduardo Hernandez Muñostes, Errazuriz 563, Playa Ancha, Valparaiso; Abraham Wurman Shapiro, San Isidro 1065, Santiago, both of Chile

[21] Appl. No.: 643,542

[22] Filed: May 6, 1996

[51] Int. Cl.[6] ..... F41F 1/00

[52] U.S. Cl. ..... 89/132; 89/143; 89/149; 42/16; 42/69.02

[58] Field of Search ..... 89/128, 143, 132, 89/149; 42/14, 15, 16, 69.02

[56] References Cited

U.S. PATENT DOCUMENTS

| | | | |
|---|---|---|---|
| H144 | 10/1986 | Savioli | 89/142 |
| 1,454,039 | 5/1923 | Chevallier | 89/139 |
| 2,548,622 | 4/1951 | Sampson et al. | 42/69 |
| 2,550,280 | 4/1951 | Martin et al. | 89/139 |
| 3,711,980 | 1/1973 | Palama | 42/16 |
| 4,679,487 | 7/1987 | Houseman | 89/140 |
| 4,681,020 | 7/1987 | Polanecky | 89/138 |
| 4,704,944 | 11/1987 | Bercu | 89/132 |
| 4,760,663 | 8/1988 | Zedrosser | 42/15 |
| 5,373,775 | 12/1994 | Findlay, Sr. et al. | 89/137 |
| 5,412,894 | 5/1995 | Moon | 42/69.02 |
| 5,517,896 | 5/1996 | Perrine | 89/189 |

FOREIGN PATENT DOCUMENTS

| | | |
|---|---|---|
| 617792 | 6/1926 | France . |
| 176906 | 9/1904 | Germany . |
| 131931 | 9/1919 | United Kingdom . |

OTHER PUBLICATIONS

PCT Search Report, Jan. 27, 1997, PCT/US96/11209.

*Primary Examiner*—J. Woodrow Eldred
*Attorney, Agent, or Firm*—Omri M. Behr, Esq.

[57] ABSTRACT

A portable firearm employs a frame and an upper mechanism having a bolt and a sliding hammer. A barrel assembly is supported on the frame and has an axis, a muzzle and a breech. The sear transversely straddles the barrel assembly and can project above its axis for restraining the hammer. A trigger mechanism employs a reciprocatable member coupled to the sear for selectively operating the sear automatically or semi-automatically. An intervening member is mounted to reciprocate transversely to the axis of the barrel assembly. This intervening member can retract upon the hammer moving against the intervening member. The intervening member is bifurcated to straddle and reciprocate transversely to the axis of the barrel assembly.

35 Claims, 12 Drawing Sheets

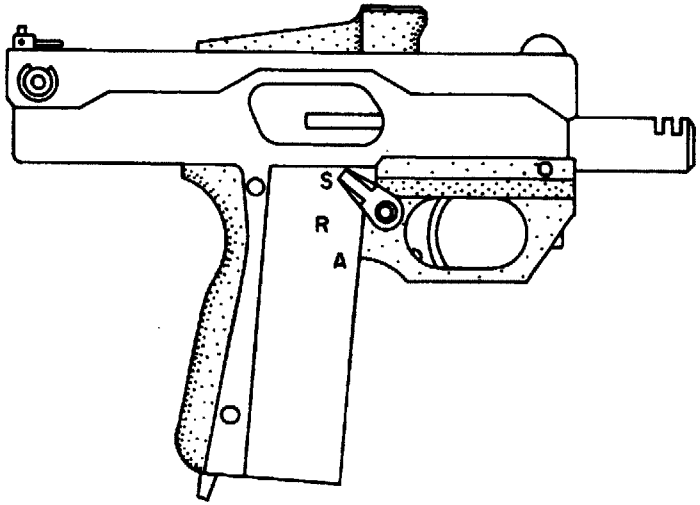
FIG. IA-1
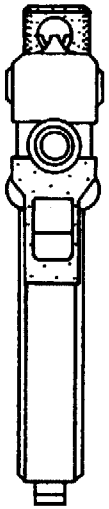
FIG. IA-2

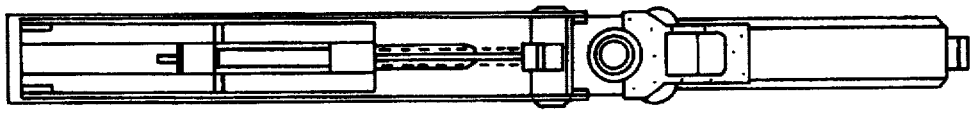
FIG. IB-2
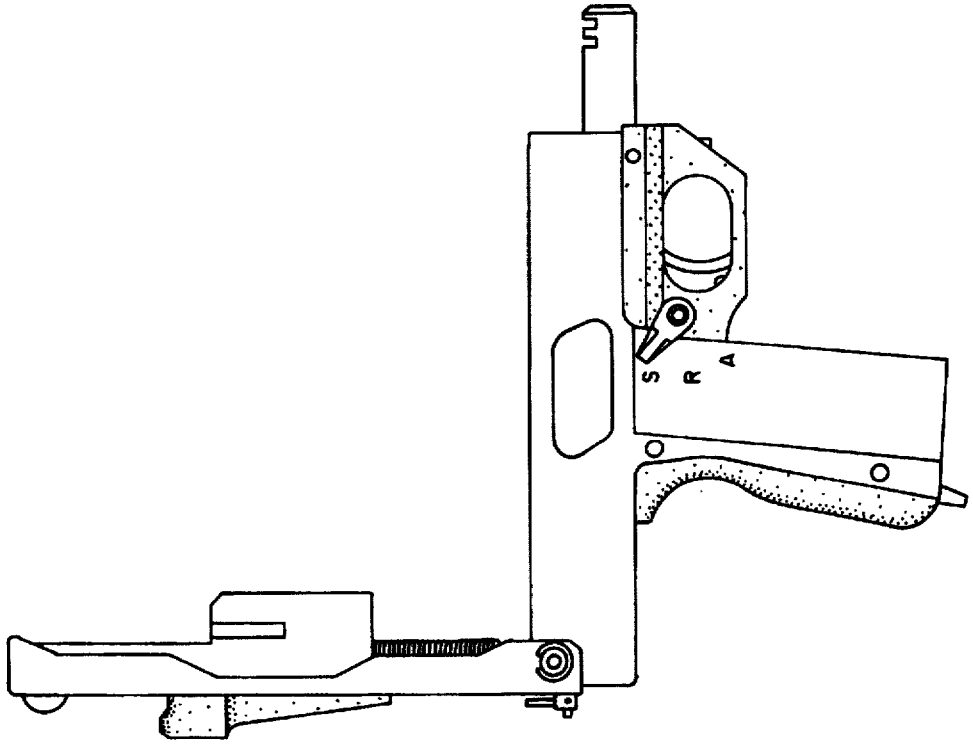
FIG. IB-1

AUTOMATIC FIREARM ARRANGED FOR HIGH SAFETY AND RAPID DISMANTLING

BACKGROUND OF THE INVENTION

1. Field of the Invention

The present invention relates to firearms, and in particular, to pistols selectively operable in either an automatic or semi-automatic mode. The invention is especially useful with firearms that are portable, suitable principally for use with only one hand, such that it is feasible to shoot in semiautomatic fire as well as automatic fire, destined to the ends of defense of institutions.

2. Description of Related Art

Portable automatic arms are known in which a mechanism is prepared for an event and which receives the energetic opening of the cartridge, makes the firearm function, on squeezing its trigger.

These arms have as principal disadvantages that their size has been reduced but not their complexity, resulting in much inconvenience in dismantling for simple cleaning or basic maintenance. Such maintenance requires one to disassemble a series of pieces and parts for such basic but important necessities, requiring at the same time very rigorous training for the operator who easily can lose pieces or make a mistake because of pressure, nervousness, lack of light or cold, which translate into the loss of the firearm for an indefinite period. Furthermore the firing mechanisms are so bulky that they impede the positioning of the bore very low and close to the hand of the shooter, which would considerably reduce the movements caused by recoil, making the firearm in automatic fire, difficult to control and inefficient even for experienced shooters.

Poor security exists in current designs since the components of the retainers of the percussion or hammer mechanisms act in very small areas, and can find themselves affected and overcome by accidental blows or falls, with a high risk of accidental or unexpected discharges, while at the same time one is sacrificing strength in order to reduce the total weight of the firearm.

U.S. Pat. No. 4,679,487 shows a weapon that can be fired in an automatic or semi-automatic mode. This barrel is connected to a bolt assembly, wherein both can pivot upwardly to expose the lower mechanisms. Mounting the barrel on a hinge reduces the structural rigidity of the overall assembly. The lower mechanisms include a replaceable cassette that includes the trigger, sear and other related components. The fully automatic mode illustrated in FIG. 19 is established by bringing pin 128 located in a slot 130 in sear 110 under the forward tip of sear actuator 132. Accordingly, the sear 110 can be retracted when bolt 30 recoils and reciprocates trip actuator 140. A disadvantage with this mechanism is the fact that essentially the entire operating mechanism (excluding of course the firing pin) is located below the axis of the barrel. Thus space is needed between the trigger and barrel axis to accommodate the sear and triggering mechanisms. Consequently, the barrel tends to be high relative to the hand that fires the weapon, thereby producing a relatively high moment upon recoil. Also the barrel is so hinged as to not only reduce the overall structural rigidity of the assembly, but to introduce a moment during recoil tending to open the weapon by swinging the barrel up. This moment is created since the recoil forces operate above the hinge pin 74 in a direction tending to open the weapon.

U.S. Pat. No. 970,307 shows a pistol wherein the barrel is hinged on pin 7 to swing upwardly and expose the pistol's operating mechanism. Very little detail is given of the components associated with the trigger mechanism. It appears however that that mechanism is located between the trigger and the axis of the barrel so as to keep the barrel relatively high. Also, the barrel is hinged and is not therefore securely attached to the frame of the pistol.

U.S. Pat. No. 3,798,819 shows a pump shotgun having hinged to it an auxiliary stock. This hinged stock does not swing upwardly for the purpose of facilitating disassembly.

U.S. Pat. No. 4,409,882 shows a gun frame made from a plurality of interlocking plates that form a box-like structure. The pistol only operates in a semi-automatic mode. During recoil, the slide 37 resets the hammer 8 and sear 13. As breech block 42 recoils it retracts disconnector lever 44 (FIG. 3) which allows pawl 30 to rise in front of the disconnector. In this position the trigger 28 and trigger pawl 30 can no longer operate the disconnector until the trigger is released. After release, the upper end of pawl 30 can re-engage the end of the disconnector to operate the sear 13. The operating components for the trigger mechanism are essentially located below the axis of the barrel, which has a tendency to require the barrel to be located high relative to the trigger.

U.S. Pat. No. 2,533,283 shows a trigger mechanism that operates in either automatic or semi-automatic mode. There is no disclosure of a hinged structure. A change lever 40 can be operated to change the manner of operation of connector 10. Connector 10 can either keep the lever 28 in an automatic or semi-automatic position, so that sear 29 is selectively able to stop the bolt between rounds, depending upon the position of the change lever 40. This triggering mechanism is again located essentially below the axis of the barrel of the weapon.

In U.S. Pat. No. 2,383,487 the illustrated weapon can operate in an automatic or semi-automatic mode. In semi-automatic mode, the trigger T (FIG. 10) rotates sear S to release hammer H. On recoil the hammer H is reset on one of the two catches of the sear. In automatic mode, the sear trip ST is elevated to a position which allows the trip pin TP to operate the sear trip ST and thus the sear S, to automatically recycle the weapon. Again, this triggering mechanism is all located essentially below the axis of the barrel of the weapon.

U.S. Statutory Invention Registration Number H144 shows triple sears 34, 36 and 38 and a trigger 11 that operates through a spring-biased plunger 41. Depending upon the position of the fire selector 54, the weapon can operate in either automatic or semi-automatic mode. In the semi-automatic mode, plunger 41 slips past the sears so they can later act to restrain the firing mechanism and prevent subsequent firing until the trigger is released. When the trigger is released, plunger 41 slips back to an active position on the underside of the sears. Again, this mechanism is all located essentially below the center line of the axis of the barrel.

U.S. Pat. No. 552,334 shows a pistol grip having a saddle-shaped backplate mounted on springs to absorb the impact of recoil.

U.S. Pat. No. 1,516,540 shows an automatic pistol that is easily disassembled by pushing back the breech block and unscrewing the barrel. No details are given of the triggering mechanism.

U.S. Pat. No. 4,567,810 shows a submachine gun having a front and rear sear controlled by a front trigger and rear trigger, respectively. The triggering mechanism is essentially located below the barrel axis.

The automatic firearm of U.S. Pat. No. 2,563,720 employs a safety mechanism that places the trigger in a safe condition when a cartridge is removed. No details are given of the triggering mechanism, other than the connection between the magazine trigger and safety.

U.S. Pat. No. 4,681,020 shows a detent for restraining the slide of an automatic firearm. The detent employs lever arms on both the right and left side of the firearm.

U.S. Pat. No. 4,090,316 shows a firing pin with a back end that can be lowered by a release lever into alignment with a recess in a hammer. When the release lever lifts the firing pin out of alignment with the hammer recess, the hammer can then strike the firing pin to fire the weapon. This automatic weapon has its triggering mechanism located essentially below the axis of the barrel.

U.S. Pat. No. 747,858 shows an automatic firearm with triggering components located below the axis of the barrel. The barrel has a series of lower ridges that engage grooves in the gun. Rotation of the barrel can disengage those ridges from the grooves. When the slide breech is removed the gun barrel can be easily removed.

In view of this situation there is a need for a simple weapon, securely controllable in its functions, solid but at the same time light, while excelling in the ability to quickly and simply dismantle the weapon without the need for any tool, or excessive instruction in this regard.

SUMMARY OF THE INVENTION

In accordance with the illustrative embodiments, demonstrating features and advantages of the present invention, there is provided a portable firearm having a frame and an upper mechanism including a bolt and a sliding hammer. The firearm also has supported on the frame a barrel assembly having an axis, a muzzle and a breech. Also included is a sear means for projecting above the axis of the barrel assembly and restraining the upper mechanism. The firearm also has a trigger means with a reciprocatable member that is coupled to the sear means for selectively operating the sear means automatically or semi-automatically.

An automatic firearm according to a second aspect of the invention has a frame. The firearm also has a barrel assembly that is supported on the frame and has an axis, a muzzle and a breech. Also included is a mechanism including a bolt and a sliding hammer. The firearm has a sear and a trigger means. The sear transversely straddles the barrel assembly for restraining the mechanism. The trigger means has a reciprocatable member coupled to the sear for selectively operating the sear automatically or semi-automatically.

An automatic firearm according to a third aspect of the invention has a frame and a barrel assembly. The barrel assembly is supported on the frame and has an axis, a muzzle and a breech. The firearm also has a mechanism including a bolt and a sliding hammer. Also included is a sear means for restraining the mechanism. The firearm also has a trigger means with a reciprocatable member coupled to the sear for selectively operating the sear automatically or semi-automatically. Also included is an intervening member mounted to reciprocate transversely to the axis of the barrel assembly and to retract upon the hammer moving against the intervening member. The intervening member is bifurcated to straddle and reciprocate transversely to the axis of the barrel assembly.

Firearms according to the principles of the present invention overcome disadvantages of the prior art and constitute a third generation weapon. Preferred embodiments of the weapon achieve a reduced form with few pieces and with the trigger acting over a large area of contact with the striker, and very close to the bore. The bore axis can be very low with respect to the hand supporting the weapon by its grip, which at the same time serves the function of charger carrier. A preferred pivoting top to the mechanism box, where the bolt serves its function and over which go the rear sight, the sight and the activating lever.

This preferred weapon is destined to be applied in defense as well as in police activities or institutions related to internal and external security as well as civil use. It possesses as characteristics, ease of dismantling in a single piece for cleaning and basic maintenance, reinforced hooks in the percussion mechanism, and a high level of control even in automatic fire, which are very superior to similar weapons, being able to reduce its size to very small forms. It can be fabricated with common and of marginal quality materials, without reduction of its good functioning.

It is found constructed of a mechanism box united to a grip in a solid form, provided with a simple mechanism which includes a pivoting top, having various components united thereto. The weapon preferably employs a firing detainer system transverse to the bore, being also provided with a firing selector and an efficient safety.

DESCRIPTION OF THE ILLUSTRATIONS

The above brief description as well as other aspects of the present invention will be more fully appreciated by reference to the following detailed description of presently preferred, but nonetheless illustrative embodiments in accordance with the present invention, when taken in conjunction with the accompanying drawings, wherein:

FIG. 1-A(1) shows the exterior right side of a weapon according to the principles of the present invention, shown closed;

FIG. 1-A(2) shows the front elevational view of the weapon of FIG. 1-A(1), shown closed;

FIG. 1-B(1) shows the exterior right side of the weapon of FIG. 1-A(1), shown open;

FIG. 1-B(2) shows the front elevational view of the weapon of FIG. 1-A(2), shown open;

FIG. 2 is an exploded view of the parts which comprise this weapon of FIG. 1-A(1);

FIG. 3 corresponds to a phantom isometric view of the mechanism box and top subassembly for the weapon of FIG. 1-A(1);

FIG. 4 corresponds to a phantom isometric view of the opening mechanism subassembly, located in the mechanism box for the weapon of FIG. 1-A(1);

FIG. 5 corresponds to an exploded, exterior, isometric view of the bore and bore holder subassembly for the weapon of FIG. 1-A(1);

FIG. 6 corresponds to a side, sectional view of the activating lever subassembly, springs and guides, located in an bolt and striker joined to a top on an axial cut, for the weapon of FIG. 1-A(1);

FIG. 7 corresponds to a partial exploded isometric view of the bolt and striker subassembly for the weapon of FIG. 1-A(1);

FIG. 8 corresponds to a partial exploded, phantom isometric view of the trigger, retainer and reinforcer, with their corresponding springs for the weapon of FIG. 1-A(1);

FIG. 9 corresponds to an exploded isometric view of the selector for the weapon of FIG. 1-A(1);

FIGS. 10-A, 10-B and 10-C correspond to the partial sectional side view of the trigger and selector acting in the three selector positions for the weapon of FIG. 1-A(1);

FIG. 11 corresponds to the side and simplified partial sectional view of the subassemblies of the bolt and striker, trigger and selector, located over a semi-assembled box functioning in safety position for the weapon of FIG. 1-A(1);

FIGS. 12-A, 12-B and 12-C correspond to the side and simplified partial sectional view of the subassemblies of the bolt and striker, trigger and selector, located over a semi-assembled box functioning in semiautomatic fire for the weapon of FIG. 11; and FIGS. 13-A through 13-D correspond to the side and simplified partial sectional view of the subassemblies of the bolt and striker, trigger and selector, located over a semi-assembled box functioning in semi-automatic mode, for the weapon of FIG. 11.

DETAILED DESCRIPTION OF THE PREFERRED EMBODIMENTS

OVERVIEW

Figure 2:
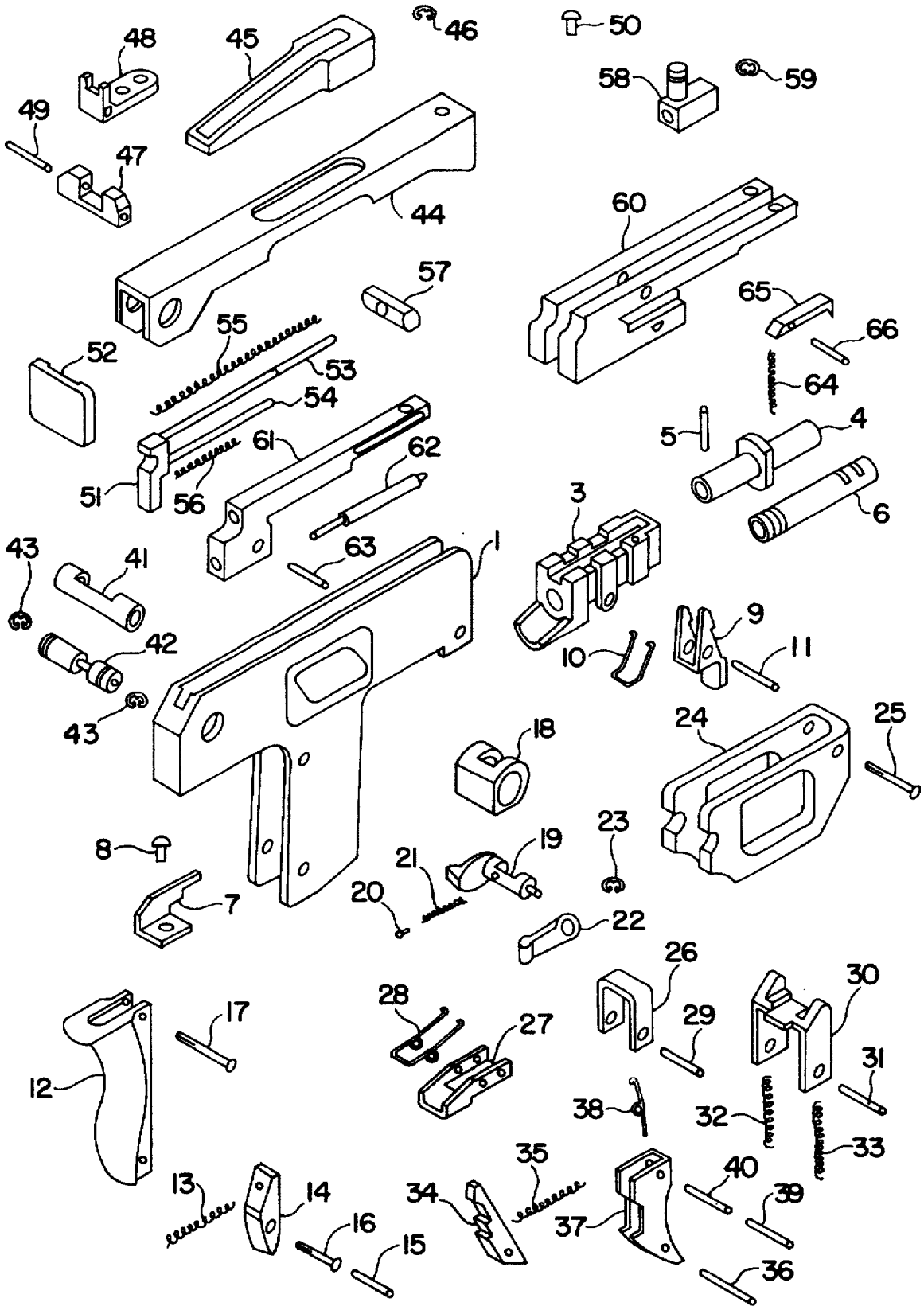

For greater descriptive simplicity it is arbitrarily divided into the following parts:

I.) Mechanism box and top.

II.) Opening or dismantling mechanism.

II.) Bore and bore holder.

IV.) Activating lever, springs and guides.

V.) Bolt and striker.

VI.) Trigger and selector mechanism.

Parts List

1) Mechanism box (frame)
2) Grip (N.B.: not shown in FIG. 1, but see FIG. 2))
3) Barrel holder
4) Barrel
5) Barrel pin
6) Barrel cover and balancer
7) Ejector
8) Ejector rivet
9) Top closure latch
10) Latch spring
11) Latch axle
12) Handle
13) Loader retainer tooth spring
14) Loader retainer tooth
15) Pin of the handle and axle of the retainer tooth
16) Axle of the loader retainer tooth
17) Upper handle pin
18) Selector base
19) Selector with wing
20) Selector guide
21) Selector spring
22) Right selector wing
23) Right selector wing C-clip retainer
24) Gunlock guard
25) Axle pin for gunlock guard and latch
26) Sear
27) Balance
28) Balance reset spring
29) Pin for balance and sear
30) Intervening member and automatic fire reinforcer
31) Reinforcer pin
32) Automatic fire reinforcer spring
33) Automatic fire reinforcer spring
34) Trigger actuator
35) Actuator spring
36) Actuator axle
37) Trigger
38) Trigger reset spring
39) Trigger axle pin
40) Trigger axle
41) Pivot reinforcing tube
42) Pivot
43) Pivot C-Clip retainers
44)Mechanism box cover
45) Activating lever
46) Activating lever C-clip retainer
47) Rear sight base
48) Rear sight
49) Rear sight pin
50) Sight point
51) Guide bar
52) Shock-absorber
53) Bolt guide
54) Hammer guide
55) Bolt reset spring
56) Hammer drive spring
57) Bolt fulcrum axle
58) Activating lever base
59) Bolt guide C-clip retainer
60) Bolt
61) Hammer
62) Firing pin
63) Firing pin axle
64) Extractor spring
65) Extractor
66) Extractor pin

I. MECHANISM COMPARTMENT AND TOP

Figure 3:
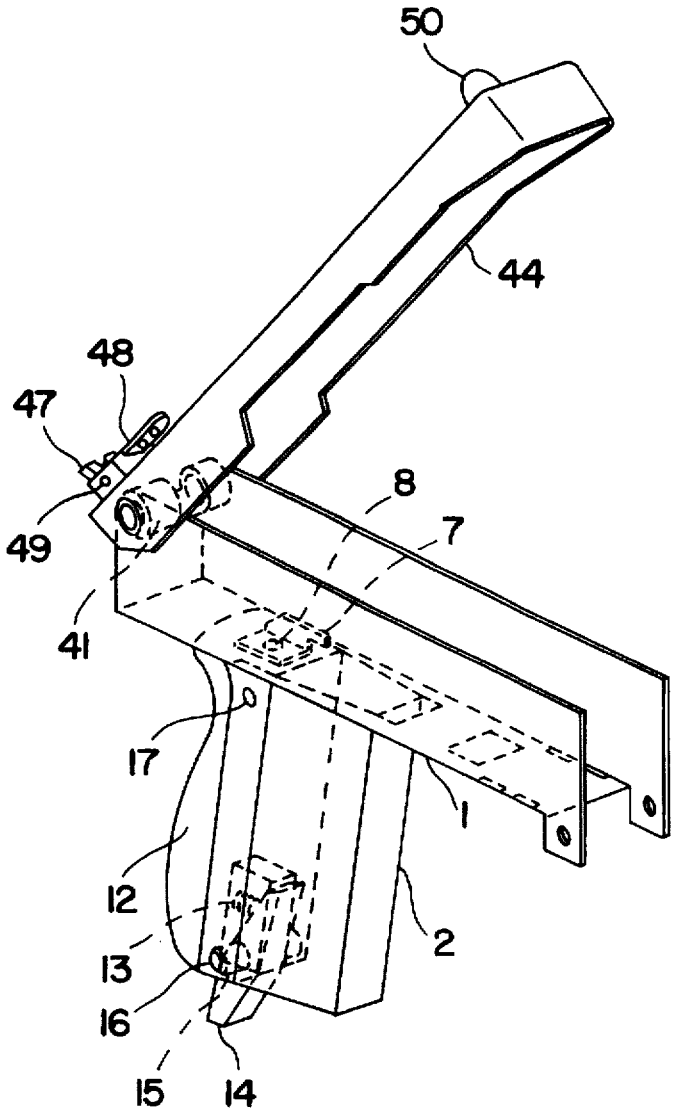

This frame 1 represented in FIG. 3 consists of a pair of stamped metal pieces, which form a channel closed at one end by folding and welding, and which has openings in its interior part suitable for lodging a trapezoidal or rectangular magazine, in addition to the corresponding space for the feeding ramp of the barrel holder 3 (as well as the projection of the holder 3 for supporting the trigger means, the tracks for sear 26 and intervening member 30). Frame 1 also has a side opening which constitutes an expulsion vent, and some apertures at the closed end toward the top which constitute the pivot point for cover 44, reinforced with a reduced tube 41 welded to frame 1, through the interior.

Frame 1 additionally has projecting down at the open end, a perforated wing, which serves as an axle for the latch mechanism, and as a base for the gunlock guard. A lower groove gives room for ejector 7, which is affixed to frame 1 by means of a rivet 8.

Grip 2 is formed by a channel stamped in a section in accord with the sole of the magazine and whose width is large enough to fit handle 12, which permits the user a conformable grip. This handle 12 has in its front part a groove to contain a loader retainer tooth 14 and its actuating spring 13, which pivot in turn on pin 15, which simplifies the dismantling of handle 12, subject to grip 2, by means of pins 15 and 17, one of which passes through the interior of bushing 16, reinforcing the axle of the loader retainer 14.

Frame 1 and grip 2 are used as a solid piece, by means of a welding or any other rigid and permanent union, without the existence of mechanisms or intermediate bodies.

This weapon has a cover 44 for the mechanism box 1 closed at its front end by folding and welding and which has the form of an elongated channel, which has apertures at its pivoting end which coincide with the mechanism box 1, over which it pivots, covering it on the outside on the upper part when closed and forming a partial wrapping, which reinforces the union. This cover 44 has an elongated opening on its upper part through which the activating lever 45 slides.

The closed end of cover 44 has on its interior part grooves or perforations (not shown), which coincide with the teeth of the cover closure latch 9, and maintain the cover 44 in the closed position with respect to the mechanism box 1.

Furthermore, the cover 44 carries the aiming devices which are the sight point 50, the rear sight 48, which pivots on pin 49, over a welded base 47.

II. OPENING MECHANISM

Figure 4:
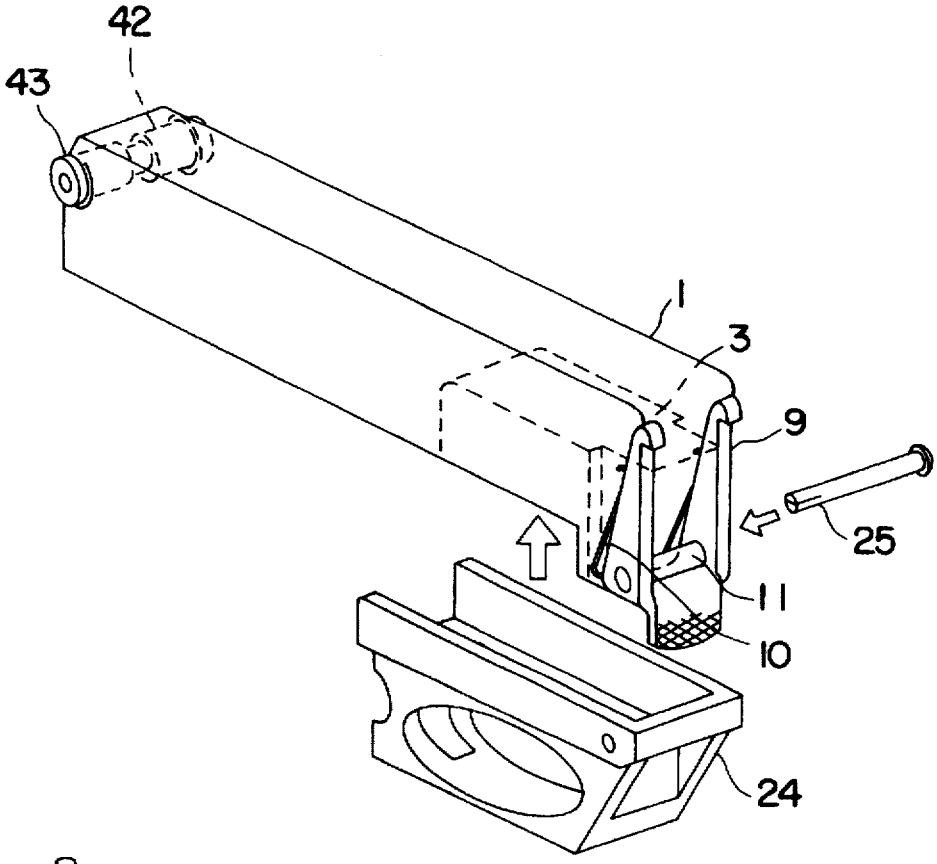

This mechanism represented in FIG. 4 consists of a closure latch 9, constructed as a simple fork (bifurcated) with hooked tines and provided with a lower projection, which permits it to be rotated about two apertures in the arms of the latch. The hooked tines of these have teeth which catch in suitable openings in cover 44, to keep it closed by action of spring 10. This rests on lateral grooves of the barrel holder 3, which also permit the lodging and limited turning of latch 9, into a lower projection of the barrel holder 3, and to the perforations of the wings of box 1, inside of which it is enclosed.

The rotation is realized in turn at axle 11, which permits the entry of pin 25, fastening gunlock guard 24, which encloses and protects trigger 37, and its mechanism, and permits the opening and closing of cover 44, by actuating latch 9.

Pivot 42 is formed with a central groove, which permits the support of the springs coinciding with the groove of bar 51. Two grooves at the ends stop the axial displacement with C-clip retainers placed over the lateral surfaces of the cover.

III. BARREL ASSEMBLY

Figure 5:
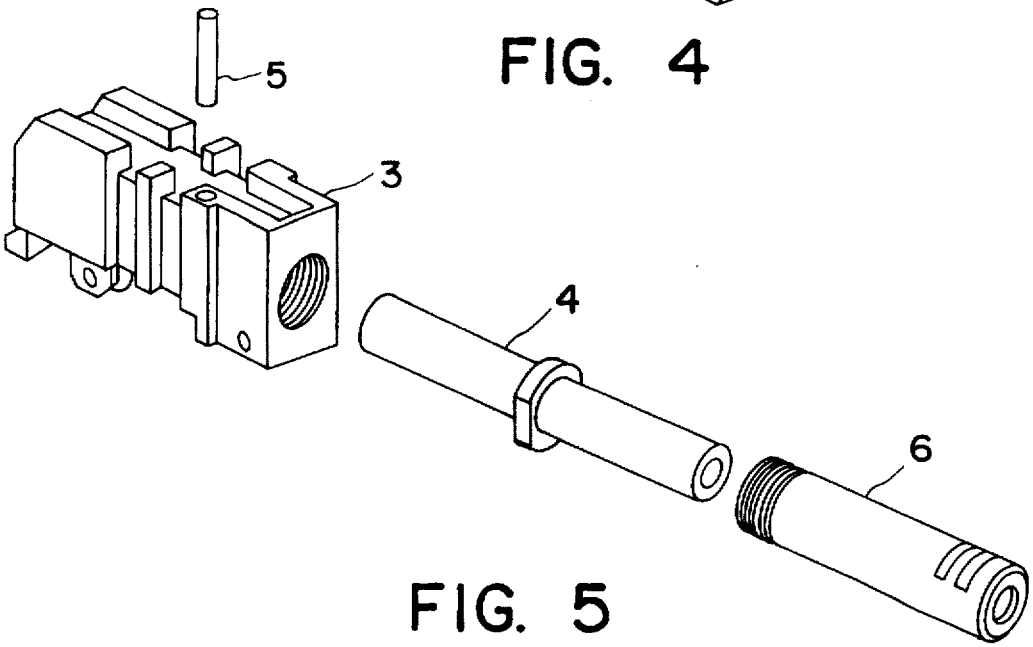

The barrel assembly is represented in FIG. 5. Barrel 4 is cylindrical and has an axis terminating at its distal end in a muzzle. Barrel 4 is surrounded with a central ring having external flat surfaces, which impede its gyration by means of pin 5. Pin 5 traverses barrel holder 3 in a form tangential to barrel 4.

The bore and chamber of barrel 4 shall be adequate to the chosen cartridge. Barrel 4 is secured by means by means of a threaded barrel cover 6, longer than the projection of the barrel in front of the ring, and over which it sits securing it to the barrel holder, which has female threads. The distal end of cover 6 has openings which serve as a balancer.

Barrel holder 3 permits positioning or removal of barrel 4, with barrel cover 6 having the corresponding openings and thread, made in a form to lower the axis of the bore as much as possible. The rear opening or breech in barrel holder communicates with the rear opening in barrel 4.

Barrel holder 3 has at its proximal end a projection which serves as a feeding ramp and at the distal end, a base for the opening mechanism. On the upper part of holder 3 there is a longitudinal groove which guide and permit the passage of hammer 61 and transverse grooves which guide and permit the passage of sear 26 (retainer bar) and the automatic fire, intervening member 30 (reinforcer), which also move along lateral channels. Sloping grooves permit the passage of the bolt on pivoting it to close cover 44.

The barrel holder 3 is united along its planes in contact with box 1 and grip 2 by welding at points or other rigid union, offering great solidity and reinforcing the barrel in a zone of great pressure.

IV. ACTIVATING LEVER, GUIDES AND SPRINGS

Figure 6:
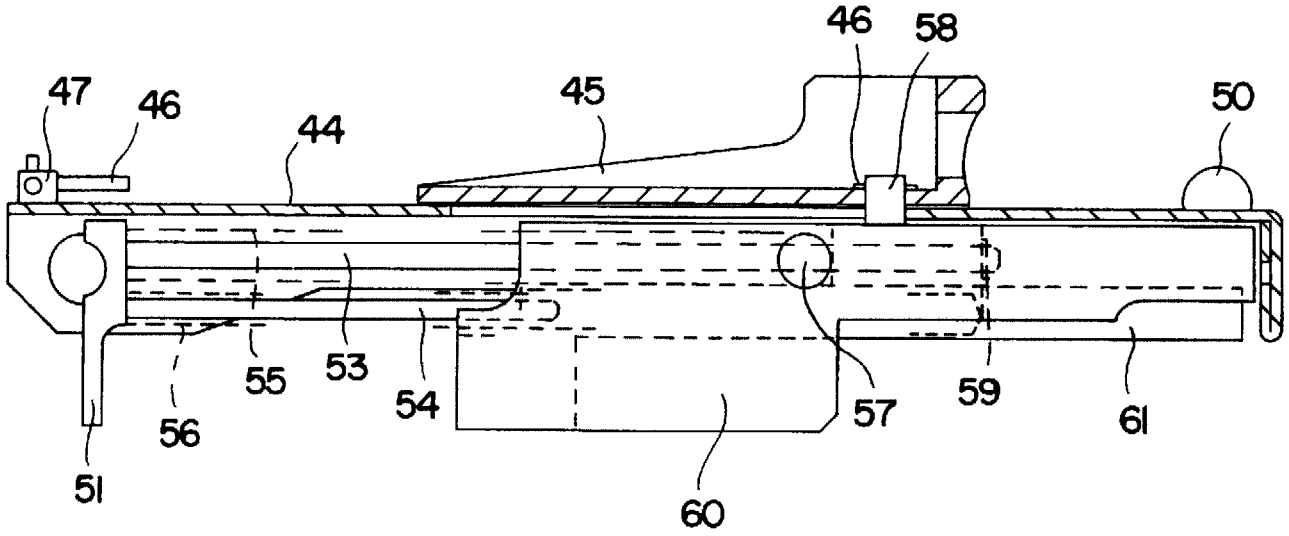

This subunit is represented in FIG. 6. Activating lever 45 permits manual movement of bolt 60 to ready the weapon or to withdraw a fed cartridge. Lever 45 operates through base 58, which has a stub that projects through cover 44 and a hole in lever 45 and is secured thereto with a C-clip retainer 46. A lower projection of lever 45 travels through the groove in cover 44 to impede lateral oscillation.

Base 58 furthermore has a longitudinal bore suitable for guide 53, on which it slides, pushing bolt fulcrum 57 in order to move this backwards to prepare the weapon for manually feeding a cartridge.

Guide 53 directs reset spring 55 to act upon fulcrum 57, in front of which lies base 58, the entity remaining united with C-clip retainer 59, in order to prevent the weapon from falling apart upon achieving partial disassembly. For this reason also the lever 45 accompanies the retracting bolt 60 when manually loading a cartridge, but subsequently returns and does not move on firing.

Another guide 54 directs percussion spring 56 for the strike hammer 61, both guides being solidly united to bar 51, which permits retention of the springs and the pivoting together of bolt 60, percussion mechanism 61/62, and cover 44 when opening. Bar 51 and guides 53 and 54, together with springs 55 and 56 are referred to as a guiding means.

The unit has high springs while the recoil force occurring on firing remains projected below the cover pivot and in a form which tends to close the cover 44.

V. BOLT AND HAMMER

Figure 7:
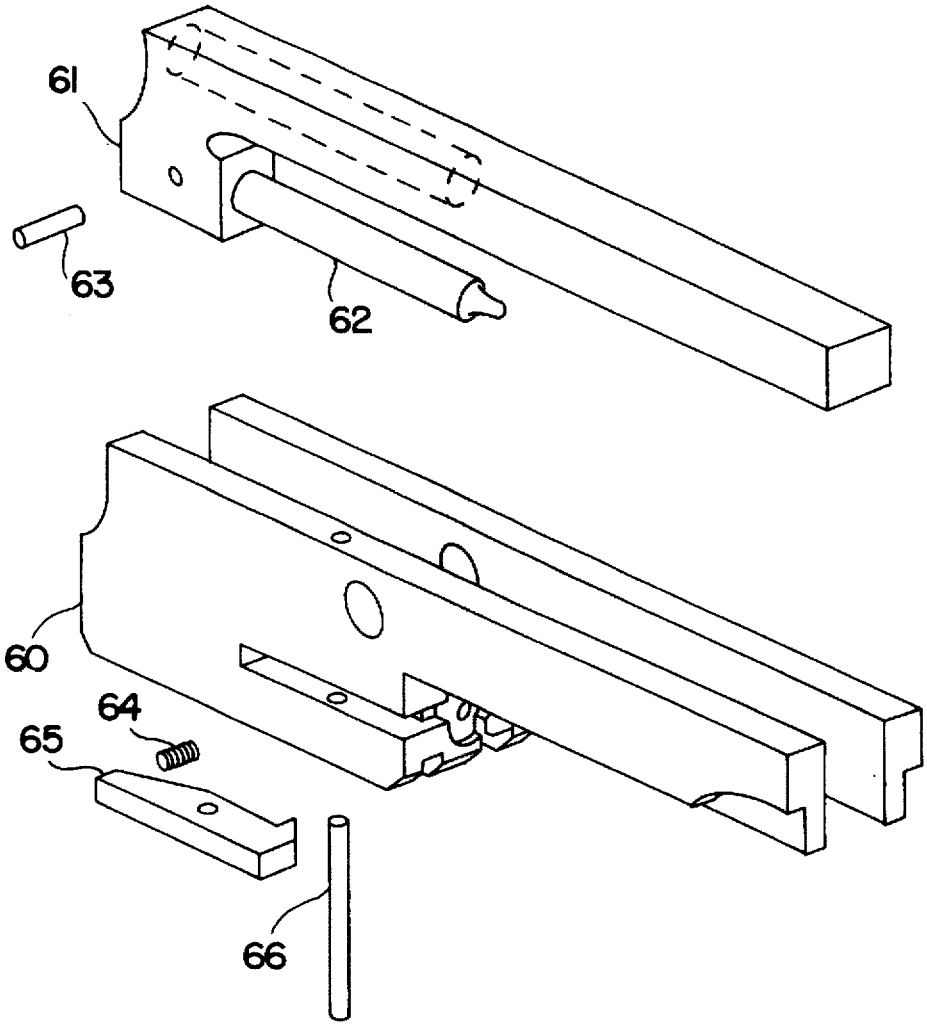

This upper mechanism is represented in FIG. 7. Bolt 60 partially overlays the barrel to improve the balance, and is formed by a body grooved on its upper part in order to provide a longitudinal slot for the hammer, which travels therein. This cavity will also be occupied by guide 53 and spring 55, which pushes bolt 60 to close it against barrel holder 3, while bearing against pivot 42. Furthermore, it makes possible the movement of lever base 58.

Spring 55 works upon axle 57, which also compensates for angular misalignments among the pieces, and guides hammer 61. See FIG. 6.

Bolt 60 is also grooved on its back part for the passage of the head of hammer 61 and is perforated in its solid core for passage of firing pin 62.

The surface of bolt 60 facing the barrel chamber has a recess to hold the end of the cartridge, thereby also obstructing the opening of the weapon after being loaded with live ammunition, now that the cover 44 is united to bolt 60 through lever 45 and its base 58, being able only to slide over it. This structure operates as a means for locking so that a chambered cartridge does not permit improper opening of the cover and bolt.

Hammer 61 is formed by an approximately L-shaped piece, axially bored to the depth required for its impeller spring 56 and a short guide 54. Its shorter portion has a bored head paralleling the principal axis to hold by means of fixing pin 63, the cylindrical end of firing pin 62, whose distal end is suitable for striking the cartridge. Pin 62 also guides the hammer 61 in its travel within bolt 60.

Bolt 60, and hammer 61, have on their proximal ends notches which coincide with the reinforcement of pivot 41, preventing the hitting of that pivot at the end of the recoil motion. Instead, the portions below the notches hits on discharge against the back of frame 1, which is provided with an elastic shock-absorber 52, manufactured of some polymer with elastic characteristics capable of absorbing part of this recoil.

Bolt 60 has on its interior face grooves which permit feeding from some charger and the passage of ejector 7, which projects from the bottom of box 1, engaging either the butt of a cartridge or a shell held in place by extractor 65 pushed by spring 64. Ejector 7 when thrust through a lateral groove of bolt 60, will launch the shells through the small lateral expulsion vents of frame 1, when the bolt is pulled back.

The two frontal arms of bolt 60, formed by the upper groove, have grooves which coincide with projections of the automatic fire, intervening member 30, which is depressed at the moment of closing, leaving free the passage of hammer 61. Member 30 is bifurcated to straddle the barrel assembly.

The assembly of the bolt and striker unit includes therefore, the pieces of the bolt 60, extractor 65, hammer 61, pin 62, guides bar 51, fulcrum axle 57, lever base 58, guides 53 and 54, springs 55 and 56 and some other minor parts, retaining it through retainer 59, over guide bar 53, keeping it as a unit with its springs in low compression.

The stud of base 58, passes across cover 44, in order to unite it to lever 45, by means of retainer 46, forming the entity which pivots over the mechanism box. See FIG. 6.

VI TRIGGER AND SELECTOR MECHANISM

The trigger means is comprised of two distinct retainers, one for each firing modality: semi-automatic (shot by shot, repetition) or automatic (bursts). The second is independent and functions on disconnecting the first as is described below.

TRIGGER AND SEAR

Figure 8:
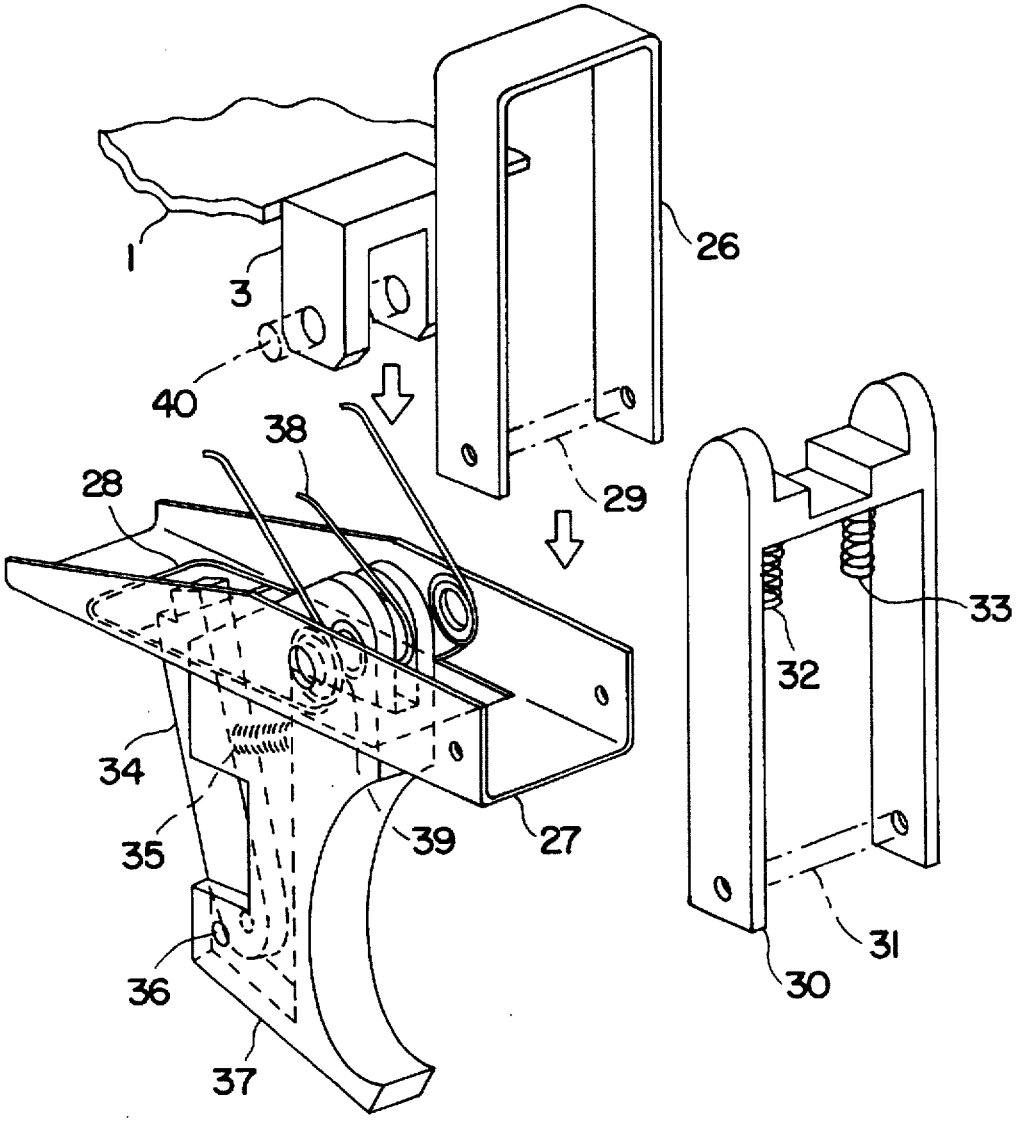

The trigger means represented in FIG. 8 is comprised of the following parts:

Trigger 37, longitudinally grooved and provided with perforations in order to pivot on its upper end, in turn to a pin 39, providing the movement which the shooter realizes on pressing the trigger 37. Pivoting on an axle 36 on trigger 37, is an actuator tooth 34, which temporarily connects it with balance 27. (Tooth 34 also referred to as a steerable member, while balance 27 is sometimes referred to as a reciprocatable member).

Pin 39, whose extension corresponds to the thick part of trigger 37, and which is lodged in its pivot's aperture, keeping inside the groove reset spring 38, in order to simplify assembly. This spring 38 permits the trigger 37 to return to its initial position.

An axle 40, which constitutes the center of the pivot of the trigger 37 and balance 27, over their common base, which is a projection or lower region of barrel holder 3, positioning the trigger 37 on the inside and the balance 27 to the outside of the trigger and base.

An axle 36, whose extension corresponds to the thin part of trigger 37, is fixed in this and is where the pivoting occurs for actuator tooth 34 (also referred to as a steerable member.

Actuator tooth 34, which pivots inside the groove of the trigger 37 and which will connect with balance 27 (also referred to as a reciprocatable member). Tooth 34 pushes balance 27, causing it to pivot about the common axis, remaining connected for an interval determined by the selector means to be described presently. A spring 35 impels tooth 34 to act on balance 27.

Balance 27 presents an opening in the middle of its body in the shape of a small rectangular canal, through which occurs the travel of trigger 37. One end of the opening in balance 27 acts as a base to place actuator tooth 34. The forward end of balance 27 has holes for pivotally attaching a sear 26 (also referred to as a sear means). In this embodiment pin 29 connects balance 27 and sear 26, permitting the partial play of both parts.

A balance reset spring 28 drives balance 27 to lift the sear 26 and return it to its initial position lodging itself in the bottom of box 1.

Sear 26 is in the shape of a quadrangular arch, which travels along the sides of barrel holder 3, on mountings suitable in shape such that the balance 27 in its angular run determines the sear's projection or its downward travel with respect to the axis of the bore which it encircles. Accordingly sear 26 holds or releases the hammer 61 in this example, or a complete bolt in the open bolt version (open bolt blowback).

It should be noted, that the major part of the pieces of the mechanism, have a geometry which duplicates the resting zones and resistance necessary for the actuation.

INTERVENING MEMBER

The weapon has, in order to improve the automatic fire function, an intervening member 30, shape approximately like a quadrangular arch, having in its upper part projections and a groove (approximating that of the striker groove cut in the barrel holder 3). The intervening member 30 extends along the side of the barrel holder 30, encircling it in a form similar to the sear 26, but located forward of the sear. See FIG. 8.

Two springs 32, 33, lift the intervening member 30 to project over the barrel holder in order to retain the hammer. A pin 31, limits the movement of the intervening member, preventing it from leaving.

It is noted that this intervening member is not required in weapons of simple backward motion provided with open bolt.

SELECTOR UNIT

Figure 9:
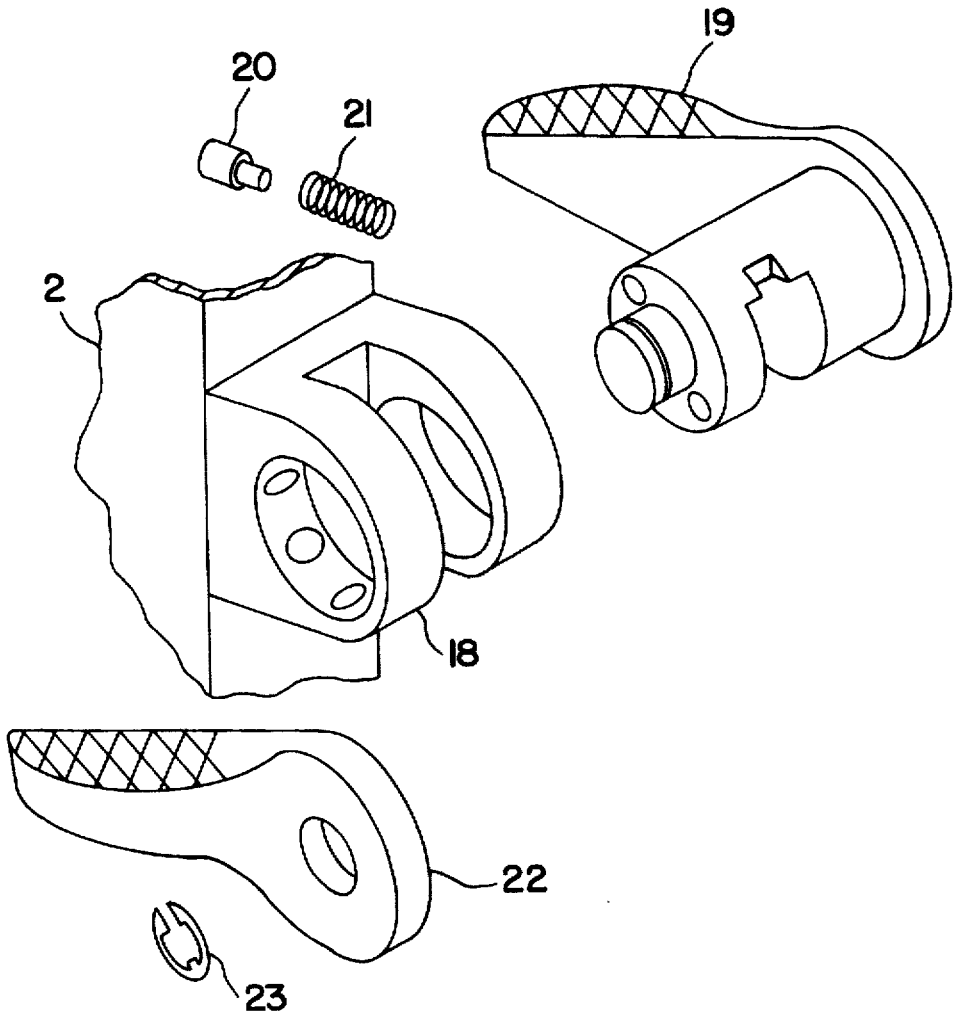

The selector means of embodiment of FIG. 9, consists of the following parts:

A support base 18 joined to the mechanism box permits placement there of the selector. The selector is formed with a support 18 with two holes to pivot the selector in its three positions (safety, semi-automatic or automatic fire) and detents for fixing the lever in these.

Figure 10C:
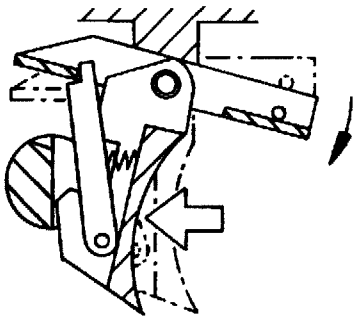
Figure 10B:
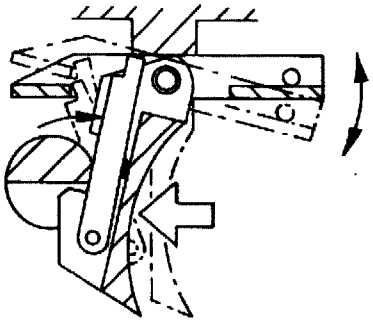
Figure 10A:
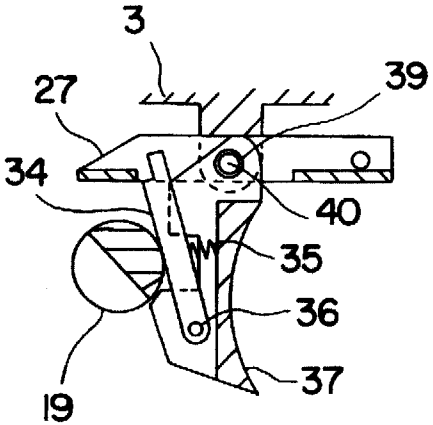

A selector lever 19, having a cylindrical shaft with central grooves perpendicular to the axis which establish:

A) Blockage of the trigger and actuator tooth in safety (FIG. 10-A).

B) Free passage of the trigger and ultimately contact with the actuator tooth to disconnects it from the balance in semi-automatic fire (FIG. 10-2).

C) Free passage of the trigger and actuator tooth in automatic fire (FIG. 10-C).

Note that the same functions can be completed by a tooth which sliding over grip 2 interposes itself in the cited modalities, Lever 19 has on one end a lever handle suitable for turning the selector to its positions, and at the other end, grooves for engaging another lever handle 22, permitting a fixed union of both handles by means of retainer 23, in order to constitute an ambidextrous selector.

Further, the shaft of selector lever 19 has a radial hole occupied by guide 20, and selector spring 21. These last two fix selector 19, in its positions on engaging the detents in base 18.

FUNCTION OF THE SELECTOR

The selector of this weapon acts principally on tooth 34, interposing itself or not in its trajectory and presenting three positions:

A) First Position: Safety

Figure 11:
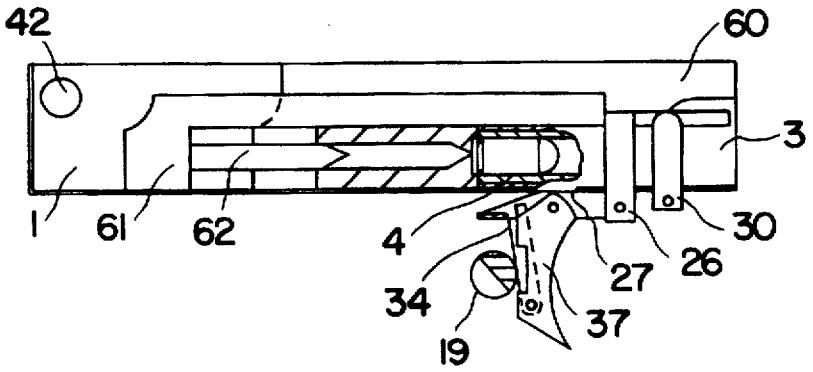

In the first position of safety, the selector 19 interposes itself on the angular movement of the trigger 37 and also forces the actuator tooth 34 inside trigger 37, hindering contact with balance 27 and eliminating any possibility of firing. This is shown in FIG. 11.

B) Second Position: Semi-automatic Fire

Figure 12A:
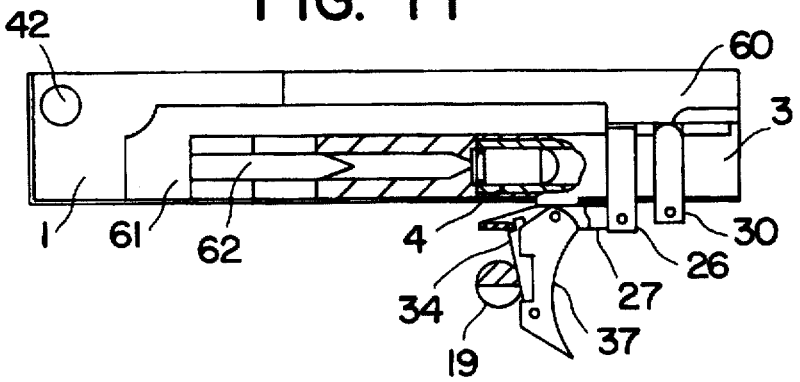
Figure 12B:
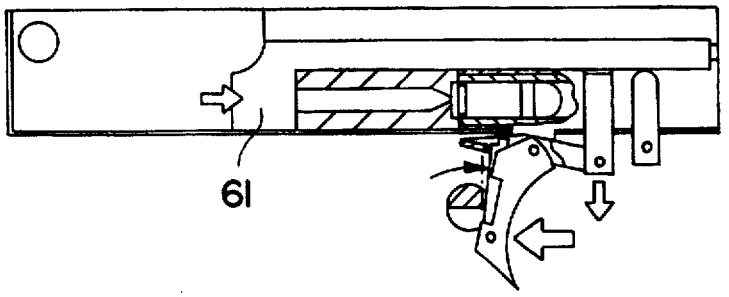
Figure 12C:
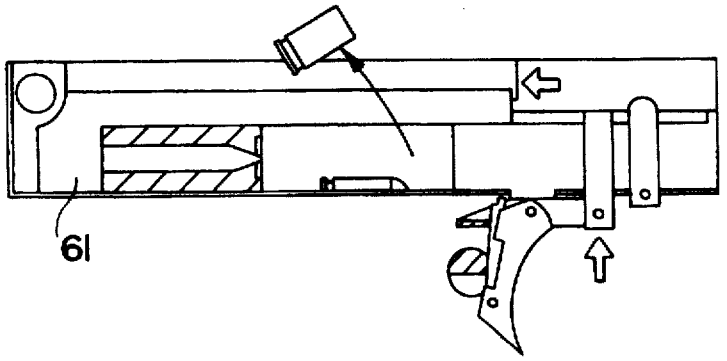
Figure 13A:
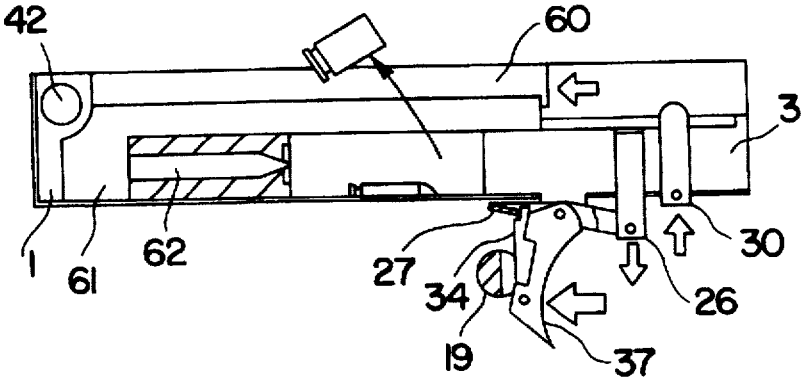
Figure 13B:
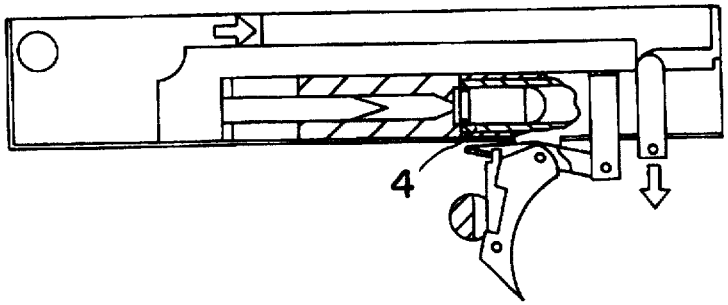
Figure 13C:
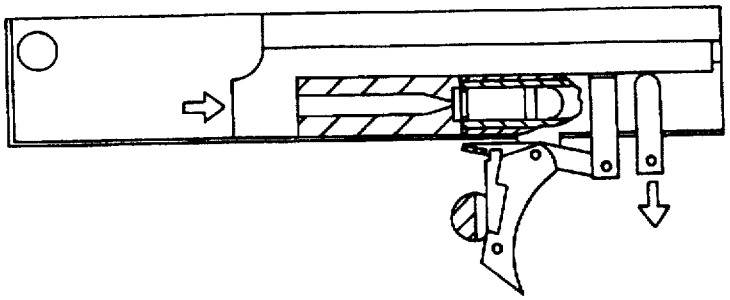
Figure 13D:
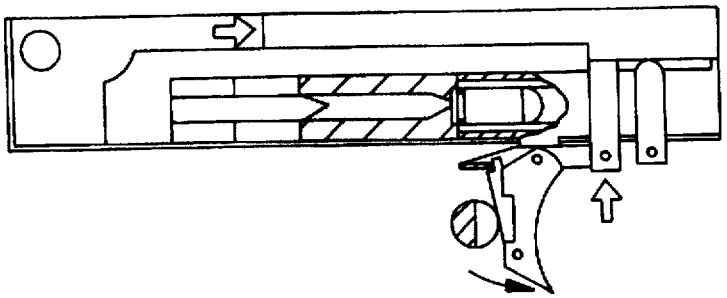

We can see in FIGS. 12-A through 12-C, the sequence for the semi-automatic fire function.

Once the weapon is readied by placing a cartridge in the chamber by means of the activating lever, it is ready to fire. In this weapon, the hammer mechanism is mounted on the upper slot of the bolt 60. The end of hammer 61 that projects from bolt 60, is retracted and travels along an upper groove in barrel holder 3, passing over sear 26, which then rises to hold hammer 61 under the compressive force of its spring 56.

It is noted that this hammer retention occurs before the bolt opening permits feeding a cartridge from the charger, for reasons of safety, thereby avoiding accidental discharges because of incomplete sweeps of the bolt 60.

The readied weapon can be seen in cross-section in FIG. 12-1. On pressing trigger 37, the actuator tooth 34, produces the pivoting of balance 27, which depresses sear 26, freeing the hammer 61, and producing a discharge as is seen in FIG. 12-A. Simultaneously tooth 34, contacts selector 19 retracting and freeing balance 27. Balance 27 then returns to its initial position and again lifts the sear 26 by means of its spring 28.

The recoil of the shell after discharge, drives back the combination of the bolt 60 and the striker 61/62. During this motion the shell ejection is produced and the retention of hammer 61 by the sear 26 occurs as illustrated in FIG. 12-C. Feeding is initiated and the weapon returns to the state of readiness, awaiting release of the trigger 37. Trigger 37 will eventually return under the influence of its reset spring 38, at which time the tooth 34 again engages balance 27, returning to the situation of FIG. 12-1.

C) Third Position: Automatic Fire

In this mode the trigger 37 initiates the first shot based on retraction of sear 26, in a manner very similar to that shown in FIGS. 12-A and -2. Here however, nothing contacts actuator tooth 34, which keeps balance 27 tilted, keeping sear 26 depressed. After the discharge the ejection is produced as described before. The intervening member 30 is projecting upward and is effective to detain the hammer 61. Feeding is initiated, as shown in FIG. 13-A.

The bolt unit 60 commences its forward run accompanied by hammer 61, and pin 62. A portion of hammer 61 extends beyond the cartridge engaging face of the bolt 60 even when a new cartridge is fed. To assure a clean strike and retard the cycling, there has been incorporated an intervening member 30. Member 30 detains hammer 61 during the feeding, the bolt 60 only continuing its trajectory until at the moment of closing, projections or notches located on its front underside engage the intervening member 30, forcing it down by compressing and overcoming 32, and 33, at which time the hammer 61 is freed as shown FIG. 13-B.

The discharge is produced as shown in FIG. 13-C, repeating all of the cycle described in parts 1 to 3, which establishes a burst of gunfire which ends when the cartridges of the charger are finished or upon release of the trigger 37, which causes retention of the hammer 61 by the sear 26. Thus the weapon remains prepared for a new burst of gunfire or change of modality to repeat or safety. This is shown in FIG. 13-D.

VII. ADVANTAGES OF THE INVENTION

The automatic pistol described in the invention, offers in comparison to other known arms, the following advantages:

Compact, lightweight and easily transported firearm.

Excellent equilibrium and control in automatic fire.

Easily carried by its grip, which facilitates its manipulation.

Easily opened for cleaning and maintenance.

Rapid opening and without need of any tool.

Basic disassembly in one single unit without producing any separation.

Does not permit disassembly when loaded and ready.

Can be assembled and disassembled with a full and inserted charger without any risk.

Cannot be fired if the weapon is found opened or incorrectly closed, because the hammer does not align with the fulminate.

Permits easy extraction of damaged pieces, shell pieces, or extraneous bodies.

Parts operate united to a single principal frame.

Independent mechanisms for automatic and semi-automatic fire.

The hammer mechanism is seared upon the opening of the bolt, before the feeding the cartridge.

Robust firing spring and driven by springs.

Highly precise because the barrel is rigidly mounted while still permitting rapid reloading.

Highly precise because it has closed framework.

Major resistance to the penetration of extraneous materials into the mechanism.

Box frame and grip united solidly, without intermediate bodies.

Parts of simple and robust construction because of their rectangular design and reinforced zones of high stress.

The number of pieces and parts are few compared to similar devices.

Ambidextrous use.

Great security against accidental discharge, because it has an extensive area of contact, between the hammer and the sear and the perpendicular movement of this with respect to the hammer.

We claim:

1. A portable firearm comprising:

a frame;

a barrel assembly supported on said frame and having an axis, a muzzle and a breech;

an upper mechanism including a bolt and a sliding hammer;

a sear means for projecting above the axis of said barrel assembly and restraining said upper mechanism; and trigger means having a reciprocatable member coupled to said sear means for selectively operating said sear means automatically or semi-automatically.

2. A portable firearm according to claim 1 and arranged for rapid opening, comprising:

a latch for releasably keeping said upper mechanism fastened to the frame, said upper mechanism being arranged to remain assembled as an entity upon opening of said firearm with said latch.

3. A portable firearm according to claim 1 wherein said trigger means comprises:

a steerable member for driving said reciprocatable member; and a selector means coupled to said steerable member for selectively steering said steerable member relative to said reciprocatable member.

4. A portable firearm according to claim 3 wherein said trigger means comprises:

a trigger, said steerable member being pivotally connected to said trigger, said selector means being operable to restrict angular motion of said steerable member.

5. A portable firearm according to claim 4 wherein said selector means is operable to prevent firing of said firearm with said triggering means.

6. A portable firearm according to claim 3 wherein said sear means comprises:

a sear transversely straddling said barrel assembly.

7. A portable firearm according to claim 1 wherein said sear means comprises:

a sear transversely straddling said barrel assembly.

8. A portable firearm according to claim 7 wherein said sear has an upper end located above the axis of said barrel assembly for releasably engaging said hammer.

9. A portable firearm according to claim 8 wherein said sear is mounted to reciprocate transversely with respect to said barrel assembly in response to rocking of said reciprocatable member.

10. A portable firearm according to claim 1 wherein said upper mechanism is secured to remain attached to said frame upon releasing of said latch to open said firearm.

11. A portable firearm according to claim 10 wherein said latch is bifurcated.

12. A portable firearm according to claim 1 wherein said frame comprises:

a pair of stamped pieces affixed together to form an enclosure.

13. A portable firearm according to claim 1 wherein said barrel assembly comprises:

a barrel having said muzzle; and a barrel holder supporting said barrel distally from said muzzle, said barrel holder being affixed to said pair of stamped pieces.

14. A portable firearm according to claim 1, wherein said upper mechanism is pivotally attached to said frame.

15. A portable firearm according to claim 1 wherein said upper mechanism is hingedly attached to an end of said firearm and arranged for rapid opening thereof.

16. A portable firearm according to claim 15 wherein said upper mechanism is mounted to pivot upwardly in elevation to move said bolt transversely to said barrel assembly.

17. A portable firearm according to claim 15 comprising:

a guiding means for separately urging said bolt and hammer forward.

18. A portable firearm according to claim 1 wherein said reciprocatable member of said triggering means is pivotally attached to said barrel assembly near its breech.

19. A portable firearm according to claim 18 wherein said barrel assembly comprises:

a barrel having said muzzle; and a barrel holder supporting said barrel distally from said muzzle, said reciprocatable member of said triggering means being pivotally attached to said barrel holder.

20. A portable firearm according to claim 15 wherein said upper mechanism comprises:

means for locking said bolt to said barrel assembly when live ammunition is loaded in said barrel assembly.

21. A portable firearm according to claim 20 wherein said bolt has a recess for partially holding live ammunition in a position spanning between said bolt and said barrel assembly, so that said live ammunition bars separation of said bolt by relative transverse motion.

22. A portable firearm according to claim 15 wherein said upper mechanism is pivoted to receive upon recoil a moment in a direction to close said firearm.

23. A portable firearm according to claim 1 wherein said upper mechanism is located at least partially above said barrel assembly, so that said barrel assembly can be mounted lower without interference from said upper mechanism.

24. A portable firearm according to claim 1 wherein said barrel assembly comprises:

a barrel having said muzzle; and a barrel holder supporting said barrel distally from said muzzle, said barrel holder having a longitudinal groove, said hammer being slidably mounted in said longitudinal groove of said barrel holder.

25. A portable firearm according to claim 1 wherein said bolt has a longitudinal slot, said hammer being slidably mounted in said longitudinal slot of said bolt.

26. A portable firearm according to claim 24 wherein said bolt has a longitudinal slot, said hammer being slidably mounted in said longitudinal slot of said bolt.

27. A portable firearm according to claim 26 wherein said upper mechanism is hingedly attached to an end of said firearm and arranged for rapid opening thereof, said upper mechanism comprising:

a guiding means for separately urging said bolt and said hammer forward.

28. A portable firearm according to claim 1 wherein said barrel assembly comprises:

a barrel having said muzzle; and a barrel holder supporting said barrel distally from said muzzle, said barrel holder having a transverse groove, said sear means being slidably mounted in said transverse groove of said barrel holder.

29. A portable firearm according to claim 28 wherein said sear means comprises:

a sear transversely straddling said barrel assembly.

30. A portable firearm according to claim 1 wherein said trigger means comprises:

an intervening member mounted to intercept and delay forward motion of said hammer.

31. A portable firearm according to claim 30 wherein said intervening member is mounted to reciprocate transversely to the axis of said barrel assembly and to retract upon said bolt moving against said intervening member.

32. A portable firearm according to claim 30 wherein said intervening member is bifurcated to straddle and reciprocate transversely to the axis of said barrel assembly.

33. A portable firearm according to claim 28 wherein said trigger means comprises:

an intervening member mounted to intercept and delay forward motion of said hammer, said intervening member being mounted to reciprocate transversely to the axis of said barrel assembly and to retract upon said bolt moving against said intervening member.

34. A portable firearm comprising:

a frame;

a barrel assembly supported on said frame and having an axis, a muzzle and a breech;

a mechanism including a bolt and a sliding hammer;

a sear transversely straddling said barrel assembly for restraining said mechanism;

trigger means having a reciprocatable member coupled to said sear for selectively operating said sear automatically or semi-automatically.

35. A portable firearm comprising:

a frame;

a barrel assembly supported on said frame and having an axis, a muzzle and a breech;

a mechanism including a bolt and a sliding hammer;

a sear means for restraining said mechanism; and trigger means having a reciprocatable member coupled to said sear for selectively operating said sear automatically or semi-automatically, said trigger means including:

an intervening member mounted to reciprocate transversely to the axis of said barrel assembly and to retract upon said bolt moving against said intervening member, said intervening member being bifurcated to straddle and reciprocate transversely to the axis of said barrel assembly.

* * * * *